US005784735A

United States Patent [19]

Ono

[11] Patent Number: 5,784,735

[45] Date of Patent: Jul. 28, 1998

[54] METHOD FOR EVENLY DYEING YARN CHEESES

[75] Inventor: Kazuhiko Ono, Kobe, Japan

[73] Assignee: Osaka Bobbin Co., Ltd., Osaka, Japan

[21] Appl. No.: 766,131

[22] Filed: Dec. 16, 1996

[51] Int. Cl.[6] ..... D06B 5/18

[52] U.S. Cl. ..... 8/155.1; 8/155.2; 68/189; 68/198

[58] Field of Search ..... 8/155.1, 155.2; 68/189, 198; 28/284, 285, 286, 290, 291

[56] References Cited

U.S. PATENT DOCUMENTS

| | | | |
|---|---|---|---|
| 875,553 | 2/1907 | Patterson | 28/285 X |
| 1,070,940 | 8/1913 | Bauer | 68/198 X |
| 2,230,067 | 1/1941 | Pedlow | 68/198 X |
| 2,382,400 | 8/1945 | Decker, Jr. et al. | 8/155.2 X |
| 2,586,078 | 2/1952 | O'Malley | 8/155.2 X |

FOREIGN PATENT DOCUMENTS

| | | | |
|---|---|---|---|
| 912686 | 6/1954 | Germany | 68/198 |
| 55-22584 | 6/1980 | Japan . | |

*Primary Examiner*—Philip R. Coe
*Attorney, Agent, or Firm*—Flynn, Thiel, Boutell & Tanis, P.C.

[57] ABSTRACT

A method for evenly dyeing yarn cheeses comprising: enveloping the cheeses, which have a generally cylindrical outer configuration, e.g. a cylindrical, truncated conical, pineapple cone form or the like, in a perforated heat-shrinkable film of a synthetic resin; applying heat to the film to shrink and adapt it to the outer configuration of the cheeses, thus wrapping up the cheeses in the film; charging the wrapped cheeses onto spindles in a dyeing machine; and flowing a dye liquor through the wrapped cheeses from inside the spindles to the outer yarn layer sides of the cheeses, and vice versa, alternatingly, thereby evenly dyeing the cheese. Preferably, the film is fashioned into a generally cylindrical body having a marginal extension projecting longitudinally through a joint line thereof, wherein the body is hot-melt sealed to form the joint line. The film can be readily removed from the cheeses by tearing along the joint line, when the extension is pulled.

4 Claims, 3 Drawing Sheets

METHOD FOR EVENLY DYEING YARN CHEESES

BACKGROUND OF THE INVENTION

1. Field of the Invention

This invention relates to a cheese dyeing method having improved evenness of dyeing, wherein yarns are wound up on bobbins for use in dyeing to form yarn packages in a cheese form called yarn cheeses, which are, in turn, dyed.

2. Description of the Related Art

Conventional cheese dyeing is performed, as shown in FIG. 4, by charging the winding yarn cheeses A on spindles 13 which are vertically mounted on a carrier 12 of a dyeing machine 11 with or without spacers 14 disposed between the yarn cheeses; and passing a dye liquor 20 through the cheeses from inside the spindles to the outer yarn layer sides of the cheeses, and vice versa, alternatingly, thus circulating alternatingly and reversingly the dye liquor through bobbin holes and spindle holes. Here, it was a customary practice with the aforesaid cheese dyeing method that after winding up a predetermined amount of yarns on each bobbin for dyeing use, the trailing end of the yarns remained free or was often stuck and inserted into the outer yarn layers of the cheeses with a latch needle or the like.

Further, in cases where the yarn cheeses have difficulty retaining their shapes, depending upon the kind of yarns, due to the sinking displacement of the outer yarn layers when mounted on spindles during dyeing, an approach of covering the yarn cheeses with a net was sometimes taken lest a worker be troubled with conveying and handling them, wherein the net was placed between the bobbin and yarns to be wound and then covered the wound yarn layers by the turning up thereof.

However, there were various problems with the former methods. The method of sticking the trailing end in the outer yarn layers not only required extra work, as such, it was likely to cause the yarn end portions to loosen out of the outer yarn layers during dyeing, as a result of which, the yarn end portions unwound and floated into the dye liquor and became entangled.

On the other hand, covering the yarn cheeses with a net for the purpose of facilitating conveying and handling the yarn cheeses was costly and required troublesome work therefor.

Moreover, in cheese dyeing, there is a general tendency that the yarn density and resistance to passage of a dye liquor through the yarn cheeses are lower in the inner yarn layers than in the outer yarn layers, with the result that insufficient contact of the outer yarn layers with the dye liquor occurs, whereby after dyeing, color differences are produced between the inner and outer yarn layers of each yarn cheese, with the outermost yarn layer being lighter.

For the same reason as above, an after-treatment agent such as a softener, smoothening agent, etc. is difficult to anchored to the outer yarn layers of the cheeses, which is responsible for causing trouble when using the yarns in the subsequent steps to dyeing.

Further problems with yarn cheeses of rayon, wool, acryl fiber, etc. are that the yarns may be displaced downwards in the dye liquor bath to such an extent that dye holes of the bobbins are exposed, often leading to a poor dyeing and, particularly in the case of yarns that after dyeing need to be dried and packaged, if packaged while still being hot, the remaining moisture content within its packaging material is condensed as droplets and the yarns will mildew.

SUMMARY OF THE INVENTION

In order to solve the foregoing problems and defects encountered in conventional cheese dyeing, this invention is based on the finding that a heat-shrinkable perforated film is advantageous for enveloping yarn cheeses therein during the cheese dyeing. Accordingly, an essential object of the invention is to restrain the dye liquor from egressing out of the outermost yarn layer of a yarn cheese enclosed by the film during dyeing, thereby prompting sufficient contact of the dye liquor with the whole yarn layers as well as to facilitating conveying and handling of yarn cheeses.

The invention for attaining the object resides in a method for evenly dyeing yarn cheeses which comprises the sequential steps of: enveloping each of yarn cheeses having a generally cylindrical outer configuration in a heat-shrinkable perforated film made of a synthetic resin; applying heat to shrink and adapt the film to the outer configuration of each yarn cheese, thus wrapping up the yarn cheeses in the film; charging the resulting wrapped cheeses, one upon another, on spindles vertically mounted on a carrier in a dyeing machine; and flowing a dye liquor through the yarn cheeses from inside the spindles to the outer yarn layer sides of the yarn cheeses and vice versa, alternatingly, to circulate alternatingly and reversingly the dye liquor in a manner ending suffient contact of it with the yarns, thus dyeing the yarn cheeses evenly.

The perforated heat-shrinkable film of a synthetic resin used in the invention is a uniaxially stretched film made of polyethylene terephthalate, polypropylene, polyethylene, or the like and has a plurality of perforations of 0.3 to 3 mm in diameter, through which a dye liquor is passed, made by a known perforating means. The film has a larger size than the yarn cheese to the extent that the film, upon shrinking, conforms to the outer configuration of the yarn cheese.

In one embodiment of the invention, the perforated heat-shrinkable film is fashioned into a generally cylindrical form by adhesive bonding or hot-melt sealing both edges of the film.

In a more preferred embodiment, the heat-shrinkable film is fashioned into a generally cylindrical body having a marginal extension, preferably of 30 to 50 mm wide, projecting longitudinally along the body at its joint line portion, wherein the body is hot-melt sealed to form a joint line portion preferably of 0.1 to 1.0 mm wide. With this generally cylindrical film having the marginal extension, the film is shrunk, upon application of heat, to wrap up each yarn cheese along its outer configuration in a manner that the marginal extension now protrudes as upper and lower radial portions with a shorter longitudinal portion therebetween.

By the term "generally cylindrical" form or body used throughout the description and claims is meant a typical cylinder form, a truncated cone form (a frustum of cone), a barrel (pineapple cone) form, and the like. The term "generally cylindrical" will be herein-after simply referred to as "cylindrical".

Further, the film of the aforementioned kind used in this invention is relatively flexible, yet self-sustaining to such a degree that the enveloping work of yarn cheeses with the film formed in a cylindrical form with or without the extension is easy.

In the method of this invention, when such a heat-shrinkable perforated film is used and shrunk, the wrapping film is set and retains its shape along the outer configuration of each yarn cheese. Consequently, trailing ends of the yarn cheeses are held in place within the film, which does away with the need to dispose the ends by any particular means, and the outermost yarn layer is also held in place.

It is thus possible to retain securely the configuration of the yarn cheeses, which facilitates the conveying and handling of them and prevents the yarn cheeses from being fouled.

More important is the fact that the perforated film serves as a resister outside the outermost yarn layer of the cheeses upon dyeing when a dye liquor flows through the cheeses from the inner yarn layer sides toward the outer yarn layer sides, thus restraining the flow of the dye liquor past the outer yarn layers, as compared with the case without the wrapping film. As a consequence, sufficient contact of the yarns with the dye liquor is ensured, and even dyeing of the entire yarn layers is thus attained without a fading in color of the outermost or outer yarn layers.

After dyeing and drying, the used film enveloping the dyed yarn cheeses is stripped off and removed.

In the example of the film formed into a simple cylindrical form, when trying to remove the film, the film is tends to be laterally torn into several pieces, since the film is shrunk only laterally, because of the property of the uniaxially stretched film in that direction. In that case, it is time-consuming to strip off the film pieces thus torn around the yarn cheeses.

With the film formed as a cylindrical body having the marginal extension, however, the joint portion of the cylindrical body and the marginal extension is stiffened and tough due to an increased thickness of the shrunk film. Consequently, simply holding and pulling the marginal extension enables the stripping off and removal of the film readily and at one time without it tearing into film pieces.

BRIEF DESCRIPTION OF THE DRAWINGS

The invention will be described in more detail with reference to the accompanying drawings, in which.

DESCRIPTION OF THE PREFERRED EMBODIMENTS

Figure 1:
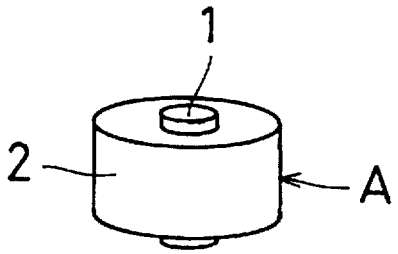
FIG. 1 is a schematic view showing one example of a yarn cheese used for the dyeing method.

First, yarns 2 are wound up on a bobbin 1 for dyeing, e.g. compressible bobbins, into yarn cheeses A as shown in FIG. 1. The cheese A can assume a form such as a cylindrical, truncated cone, pineapple cone, and the like.

Then, the yarn cheeses A are wrapped up in a heat-shrinkable film 3 having a multiplicity of perforations 4 prior to dyeing.

Figure 2A:
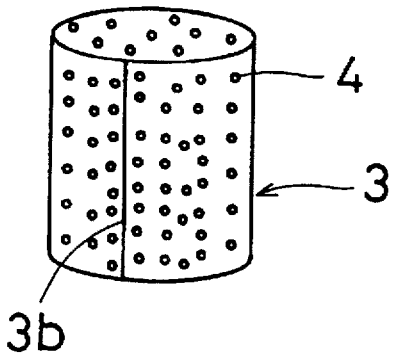
FIGS. 2A, 2B, and 2C are schematic views showing an example of a perforated film having a simple cylindrical configuration; a yarn cheese wrapped up by the cylindrical film in FIG. 2B after dyeing; and a state in which the shrunk film covering the yarn cheese shown in FIG. 2B is being stripped off, respectively.
Figure 2B:
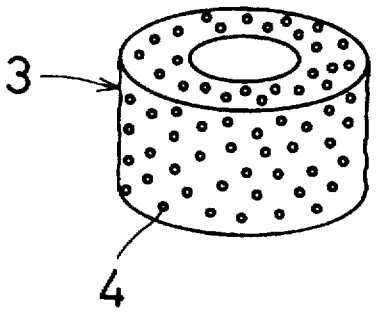
Figure 2C:
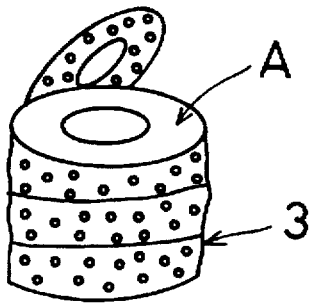

In one embodiment shown in FIGS. 2A, 2B and 2C, each yarn cheese A is wrapped up in a heat-shrinkable film 3, which assumes likewise a cylindrical form and is produced by making a plurality of perforations 4 through the film and then adhesive-bonding or hot-melt bonding both edges thereof to form a cylindrical body seamed at a joint line portion 3*b* (FIG. 2A).

Figure 3A:
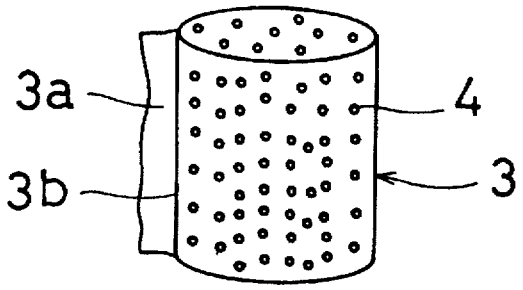
FIG. 3A is a schematic view showing another example of a perforated film fashioned into a cylindrical body having a marginal extension.

On the other hand, in a more preferred embodiment shown in FIGS. 3A to 3E, a perforated heat-shrinkable film 3 formed as a cylindrical body having an extra marginal extension 3*a* melt-bonded thereto at a joint line 3*b* of the body is used (FIG. 3A).

The dyeing method will be hereinafter explained with reference to the embodiment illustrated in FIGS. 3A to 3E.

Prior to dyeing, the film 3 is fashioned into a cylindrical form having an extension as shown in FIG. 3A by making a plurality of perforations 4 through the film 3 and hot-melt sealing the film at its edge and near-edge sides while projecting an extra marginal extension 3*a* longitudinally to seam the film at a joint line portion 3*b*. Preferably, the marginal extension 3*a* has a width of 30 to 50 mm, and the joint line portion 3*b* has a width of 0.1 to 1 mm. The provision of the marginal extension 3*a* through the joint line portion 3*b* makes it easy to strip off and remove the film 3 from yarn cheeses after dyeing. Here, the joint line portion 3*b* is preferred to be hot-melt sealed and not adhesively bonded, where it is difficult to strip the film off from the yarn cheeses.

For example, a film, made of polyethylene terephthalate and fashioned into a cylindrical body having a mariginal extension 3*a* of ca. 35 mm wide and perforations 4 of ca. 0.6~0.7 mm in diameter and ca. 16 to 18/cm$^2$ in density, can be used for the wrapping film.

The small perforations 4 are made through the film 3 in its entirety by a conventional perforating means to be distributed evenly or located more in the portions corresponding to the upper and lower positions of the cheese.

As the heat-shrinkable synthetic resin film, there may be mentioned, for example, commercially available polyethylene terephthalate, polyethylene, polypropylene, etc. produced by uniaxial stretching.

Figure 3B:
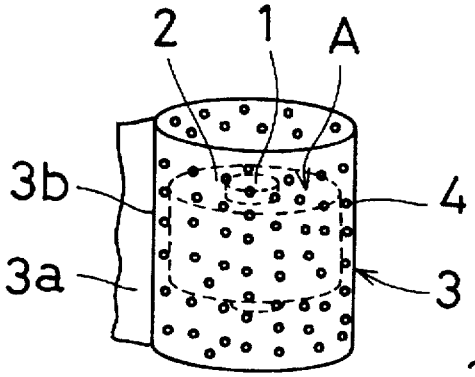
FIGS. 3B and 3C are schematic views showing the wrapping steps of the film illustrated in FIG. 3A prior to dyeing.

The yarn cheese A is enveloped within the cylindrical film 3 with the marginal extension 3*a* (FIG. 3B). To that end, the wrapping film 3 is required to have a size large enough to cover the cheeses A entirely such that the film, after being shrunk, conforms to the outer configuration of the yarn cheese, but a too large size of the film is unnecessary.

Figure 3C:
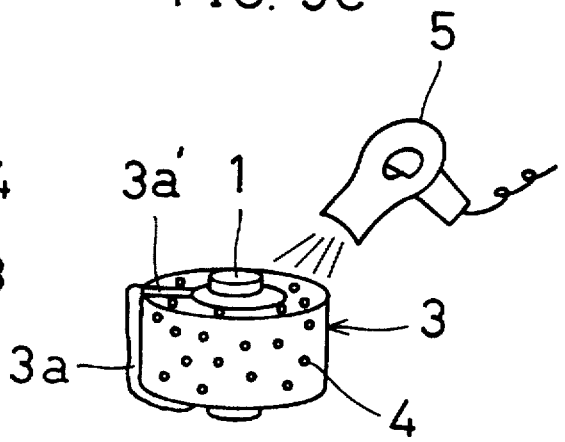
Figure 3D:
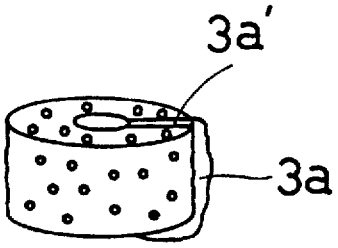
FIG. 3D is a schematic view of the wrapped cheese after dyeing.

The yarn cheeses A thus enveloped within the film 3 are then subjected to heat, for example, by a hot-air applying means 5 (FIG. 3C). At that time, the film 3 wrapping the outside of the yarn cheese A is shrunk to be in conformity with the outer cylindrical configuration of the cheese A, and thus conforms with the top and bottom sides and the longitudinal side of the cheese, with the top and bottom portions and the vertical portion of the margin 3*a* protruding. Instead of the foregoing heat applying means 5, like a hot-air blower, the wrapped cheese may be allowed to stand in a heating atmosphere.

Figure 4:
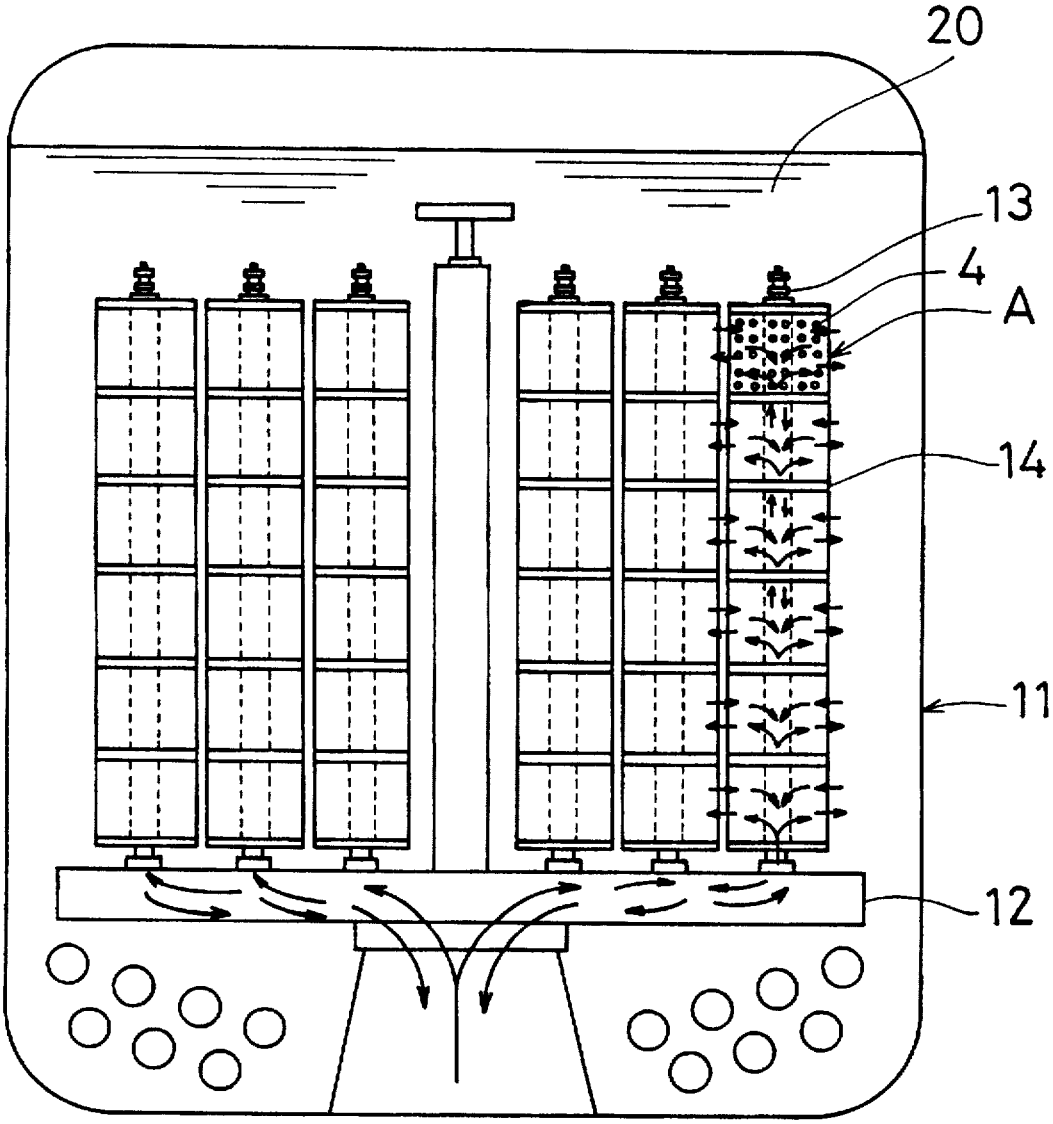
FIG. 4 is a diagrammatic representation illustrating a dyeing step of yarn cheeses in the wrapped state charged in a dyeing machine, wherein the flow directions of a dye liquor are only partly illustrated.

The yarn cheeses A thus wrapped up in the shrunk film 3 are now subjected to dyeing in a conventional dyeing machine 11 as shown in FIG. 4.

In the dyeing machine 11 containing a dyebath or dye liquor 20, yarn cheeses are charged onto spindles 12, vertically mounted on a carrier 12, one upon another while interposing each spacer 14 between the cheeses. The dye liquor 20 flows through the cheeses A from inside the spindles towards the outer yarn layer sides and vice versa, alternatingly, whereby the yarn cheeses are dyed evenly in the wrapped state. Here, the shrunk film wrapping the cheeses functions as a resister, preventing the dye liquor from passing away too fast through the outermost yarn layer, thus bringing the dye liquor into sufficient contact with the outermost yarn layer. As a result, the problem that yarns in the outermost layer are dyed lighter, as was encountered in the conventional cheese dyeing, can be solved.

Usually, one yarn cheese is wrapped up in one film, but it is also possible to wrap up a plurality of yarn cheeses in one film at one time insofar as the object of the invention is not affected.

Figure 3E:
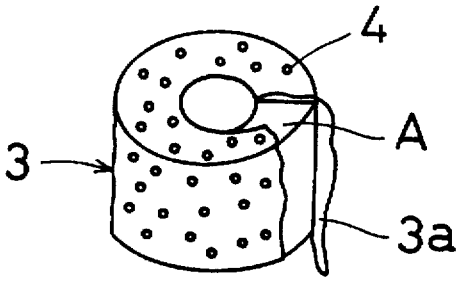
FIG. 3E shows a state in which the used wrapping film is being stripped off.

Thereafter, the dyed yarn cheeses are dried (FIG. 3D) and the used shrunk films are removed from the cheeses. Of the marginal extension 3*a* thus shrunk, the top and bottom portions 3*a*' thereof are shrunk to a large extent than the intermediate portion to be thicker-gauged and stiffer. Because of this, when the top portion 3*a*' is held and pulled with hand, the film 3 is readily torn open along the joint line 3*b* (FIG. 3E). Thus the film can be easily stripped off and removed at one time from the yarn cheeses A.

In the other embodiment shown in FIGS. 2A to 2C, the dyeing process is similarly performed to the embodiment of FIGS. 3A to 3E. That is, the yarn cheeses A wrapped up in the simple cylindrical film 3 (FIG. 2A) are likewise subjected to heat so that the film is shrunk and conforms with the outer configuration of the cheeses. After dyeing as shown in FIG. 4 and drying, the cheese illustrated in FIG. 2B is obtained. When the shrunk film wrapping the cheeses is stripped off, the shrunk film often tears laterally into donut-like film pieces upon pulling (FIG. 2C), making it time-consuming to remove the pieces.

Although several preferred embodiments have been disclosed and described hereinabove, it should be understood that this invention is in no sense limited thereby.

The advantages achieved by the improved cheese dyeing method of this invention using a heat-shrinkable perforated film of a synthetic resin are summarized as follows:

1) Being wrapped up in the shrunk film, the yarn tails of the yarn cheeses wound up on a bobbin can be secured within the film without the necessity of positioning them and consequently, it is possible to prevent floating and entangling of the unwinding yarns in the dye bath.

2) Because the cheeses are held in place in the shrunk film, shape retention of the cheeses can be maintained, preventing the downward displacement of the yarns, which facilitates carrying and handling the dyed cheeses and avoids the staining thereof.

3) The perforated shrunk film covering outer yarn layers of the cheeses serves as a resister to a dye liquor and restrains it from going out through the outer yarn layers and accordingly, assures sufficient contact between the dye liquor and the yarns, whereby an even dyeing from inner to outer yarn layers is achieved.

4) In addition to the dyeing effects above, the use of a film fashioned into a marginal extension-fitted cylindrical form instead of a simple cylindrical form enables easy and instantaneous stripping and removal of the film after the dyeing step.

What is claimed is:

1. A method of evenly dyeing a yarn cheese comprising the steps of:

providing a yarn cheese, said yarn cheese comprising a yarn wound on a bobbin to have a circular configuration;

enveloping the yarn cheese in a perforated heat shrinkable, uniaxially stretched synthetic film covering, said covering having a lengthwise linear portion which is hot-melt sealed to form a longitudinal joint and is uniaxially stretched in the lateral direction, said longitudinal joint having a fin extending laterally from and along the length thereof;

applying heat to the covering to cause it to shrink and conform to the configuration of the yarn cheese and wrap the yarn cheese tightly therein;

providing a dyeing machine having a carrier and spindles mounted vertically on the carrier;

placing the wrapped yarn cheese onto a spindle; and flowing a dye liquor from the spindle through the wrapped yarn cheese and back through the wrapped yarn cheese to the spindle to evenly dye the yarn cheese.

2. The method of claim 1, wherein the fin has a width of from 30 to 50 mm.

3. The method of claim 1, comprising the additional step of pulling the fin to tear the film covering along the longitudinal joint and remove the film covering from the yarn cheese.

4. The method of claim 1, wherein the film covering is made from a material selected from the group consisting of polyethylene, polypropylene and polyethylene terephthalate.

* * * * *